US010280499B2

(12) United States Patent
Wu et al.

(10) Patent No.: US 10,280,499 B2
(45) Date of Patent: May 7, 2019

(54) COMPOSITION AND COATING STRUCTURE APPLYING WITH THE SAME

(71) Applicant: INDUSTRIAL TECHNOLOGY RESEARCH INSTITUTE, Hsinchu (TW)

(72) Inventors: Zhong-Ren Wu, Taichung (TW); Mao-Shin Liu, Hsinchu (TW); Wu-Han Liu, Miaoli (TW); Wei-Tien Hsiao, Zhudong Township, Hsinchu County (TW); Ming-Sheng Leu, Zhudong Township, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 345 days.

(21) Appl. No.: 14/953,979

(22) Filed: Nov. 30, 2015

(65) Prior Publication Data

US 2016/0186330 A1 Jun. 30, 2016

(30) Foreign Application Priority Data

Dec. 30, 2014 (TW) ..... 103146319 A

(51) Int. Cl.

| | |
|---|---|
| ***C23C 24/08*** | (2006.01) |
| ***C23C 4/14*** | (2016.01) |
| ***C23C 24/10*** | (2006.01) |
| ***C23C 4/129*** | (2016.01) |
| ***C23C 4/134*** | (2016.01) |

(52) U.S. Cl.

CPC ..... *C23C 4/14* (2013.01); *C23C 4/129* (2016.01); *C23C 4/134* (2016.01); *C23C 24/103* (2013.01)

(58) Field of Classification Search

CPC ..... C23C 4/073

See application file for complete search history.

(56) References Cited

U.S. PATENT DOCUMENTS

| | | | | |
|---|---|---|---|---|
| 4,117,179 A * | 9/1978 | Jackson | C23C 4/08 | 427/250 |
| 4,822,689 A | 4/1989 | Fukubayashi et al. | | |
| 5,161,306 A * | 11/1992 | Nakahira | B21B 39/008 | 148/278 |
| 5,277,936 A | 1/1994 | Olson et al. | | |
| 5,507,623 A * | 4/1996 | Kojima | C23C 4/02 | 416/241 R |

(Continued)

FOREIGN PATENT DOCUMENTS

| | | |
|---|---|---|
| CN | 1427085 A | 7/2003 |
| CN | 101113487 A | 1/2008 |

(Continued)

OTHER PUBLICATIONS

Taiwanese Office Action dated Apr. 21, 2016.

(Continued)

*Primary Examiner* — Michael M Dollinger

(74) *Attorney, Agent, or Firm* — Rabin & Berdo, P.C.

(57) ABSTRACT

A composition and a coating structure applying with the same are provided. The composition includes 3 wt % to less than 15 wt % of Al, 10 wt % to less than 30 wt % of Cr, higher than 0 wt % to 15 wt % of O, higher than 0 wt % to 15 wt % of Y, and the remainder being at least one of Co or Ni.

12 Claims, 3 Drawing Sheets

(56) References Cited

U.S. PATENT DOCUMENTS

| | | | | |
|---|---|---|---|---|
| 5,652,028 | A | 7/1997 | Taylor et al. | |
| 5,700,423 | A * | 12/1997 | Gao | C23C 4/06 266/103 |
| 5,741,556 | A * | 4/1998 | Taylor | C23C 4/06 427/372.2 |
| 6,199,281 | B1 | 3/2001 | Lee et al. | |
| 6,572,518 | B1 | 6/2003 | Midorikawa et al. | |
| 6,682,780 | B2 * | 1/2004 | Tzatzov | C23C 26/00 228/262.3 |
| 6,756,131 | B2 * | 6/2004 | Oguma | C22C 19/058 416/241 R |
| 7,776,450 | B2 | 8/2010 | Mizuno et al. | |
| 8,328,705 | B2 * | 12/2012 | Kurisu | C21D 9/56 492/53 |
| 9,012,032 | B1 * | 4/2015 | Jablonski | C23C 16/405 416/241 R |
| 2011/0104449 | A1 | 5/2011 | Shigemitsu et al. | |

FOREIGN PATENT DOCUMENTS

| | | | |
|---|---|---|---|
| CN | 102766824 | A | 11/2012 |
| EP | 0469803 | A1 | 2/1992 |
| EP | 1149931 | A1 | 10/2001 |
| EP | 2034034 | A1 | 3/2009 |
| JP | 63199857 | A * | 8/1988 |
| JP | 02270955 | A * | 11/1990 |
| TW | 407086 | B | 10/2000 |
| TW | 493016 | B | 7/2002 |
| TW | 200730269 | | 8/2007 |
| TW | 200916603 | A | 4/2009 |
| TW | 200936772 | A | 9/2009 |
| TW | I428471 | B | 3/2014 |
| WO | WO-2009150867 | A1 | 12/2009 |

OTHER PUBLICATIONS

Cheng-Sheng Yu et al., "Development of Manganese Build-up Resistant Cermet Coatings for Hearth Rolls", China Steel Technical Report, No. 25, 2012, pp. 51-59.

S. Matthews et al., "Review of Thermal Spray Coating Applications in the Steel Industry: Part 1—Hardware in Steel Making to the Continuous Annealing Process", Journal of Thermal Spray Technology, vol. 19, No. 6, Dec. 2010, pp. 1267-1276.

Mineaki Matsumoto et al., "Thermal cycle behavior of plasma sprayed $La_2O_3$ $Y_2O_3$ stabilized $ZrO_2$ coatings", Scripta Materialia, vol. 54, 2006, pp. 2035-2039.

S. Matthews et al., "Review of Thermal Spray Coating Applications in the Steel Industry: Part 2—Zinc Pot Hardware in the Continuous Galvanizing Line", Journal of Thermal Spray Technology, vol. 19(6), Dec. 2010, pp. 1277-1286.

Tsai-Shang Huang, "Effect of Mn on the Formation of Oxide Buildups Upon HVOF-Sprayed MCrAlY-Ceramic-Type Cermet Coatings", Journal of Thermal Spray Technology, vol. 20(3), Mar. 2011, pp. 447-455.

* cited by examiner

COMPOSITION AND COATING STRUCTURE APPLYING WITH THE SAME

This application claims the benefit of Taiwan application Serial No. 103146319, filed Dec. 30, 2014, the subject matter of which is incorporated herein by reference.

TECHNICAL FIELD

The technical field relates to a composition and a coating structure applying the same.

BACKGROUND

Along with the promotion and progress of steelmaking technology and the increase of needs of industries for steel materials, the developments of steel materials have been gradually processed from normal electromagnetic steel sheets early applied in home appliance and automobile steel to new highly-tensile steels currently. The so-called highly-tensile steels indicate steel materials containing manganese (Mn) for increasing tensile strength. However, steel materials containing manganese (Mn) have higher affinity to oxygen and metals, such as aluminum, therefore oxidization and sticking problems may occur easily; in addition, build-ups may be easily generated on the circular rollers which contact the steel plates in the high temperature heat treatment furnace in the production process, thereby imprints may be easily remained on the steel plates which soften under high temperature, causing steel plates having poor properties.

Therefore, how to improve the coating materials contacting the steel plates has become an important research topic. Particularly, developments of new generation coating materials focusing on steel materials having high content of manganese (Mn) have become one of the goals that industries are working on.

SUMMARY

The present disclosure relates in general to a composition and a coating structure applying the same.

According to an embodiment, a composition for a coating structure is provided. The composition includes 3 wt % to less than 15 wt % of aluminum (Al), 10 wt % to less than 30 wt % of chromium (Cr), higher than 0 wt % to 15 wt % of oxygen (O), higher than 0 wt % to 15 wt % of yttrium (Y), and the remainder being at least one of cobalt (Co) or nickel (Ni).

According to another embodiment, a coating structure formed of a composition is provided. The composition of the coating structure includes 3 wt % to less than 15 wt % of aluminum (Al), 10 wt % to less than 30 wt % of chromium (Cr), higher than 0 wt % to 15 wt % of oxygen (O), higher than 0 wt % to 15 wt % of yttrium (Y), and the remainder being at least one of cobalt (Co) or nickel (Ni). The coating structure has a thickness of 50-200 μm.

The following description is made with reference to the accompanying drawings and embodiments.

DETAILED DESCRIPTION

Figure 1B:
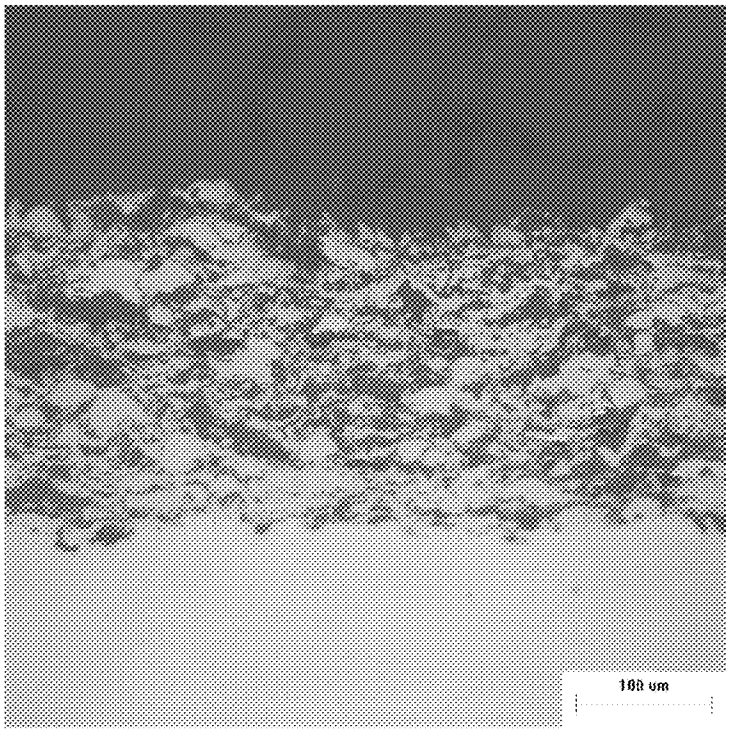
FIG. 1B shows an electronic microscopy of a coating structure according to an embodiment of the present disclosure.

In the embodiments of the present disclosure, a composition is applied in manufacturing a coating structure, such that the coating structure is provided with improved anti-adhesion and wearing resistance abilities. Details of embodiments of the present disclosure are described hereinafter with accompanying drawings. Specific structures and compositions disclosed in the embodiments are for examples and for explaining the disclosure only and are not to be construed as limitations. A person having ordinary skill in the art may modify or change corresponding structures and compositions of the embodiments according to actual applications.

According to the embodiments of the present disclosure, a composition for a coating structure is provided hereinafter. According to the embodiments of the present disclosure, the composition is such as a powder composition.

In an embodiment, the composition includes 3 wt % to less than 15 wt % of aluminum (Al), 10 wt % to less than 30 wt % of chromium (Cr), higher than 0 wt % to 15 wt % of oxygen (O), higher than 0 wt % to 15 wt % of yttrium (Y), higher than 0 wt % to 3 wt % of nitrogen (N), higher than 0 wt % to 3 wt % of carbon (C), molybdenum (Mo) or boron (B), and the remainder being at least one of cobalt (Co) or nickel (Ni). That is, according to an embodiment of the present disclosure, in the composition, in addition to the above-described Al, Cr, yttrium oxide, and boron nitride having the above-mentioned weight percentages, the remainder of the composition is Cr, Ni, or the combination of Cr and Ni.

According to the embodiments of the present disclosure, the composition is applied in manufacturing a coating structure, such that the coating structure is provided with improved anti-adhesion and wearing resistance abilities under high temperature environment. Particularly, the coating structure is provided with excellent anti-adhesion and wearing resistance abilities to the surfaces of steel materials containing manganese (Mn), such as a steel material having 1 wt % or higher of Mn, and can be used as a protection layer for metal substrates having excellent properties.

Specifically speaking, boron nitride has advantages of having a hexagonal lattice structure, low shear stress, easily forming a solid lubrication thin film with good adhesion, low wear, and chemical stability of high temperature resistance. Boron nitride has characteristics of high temperature resistance and excellent adhesion, in comparison, carbide and molybdenum sulfide ($MoS_2$) have excellent lubricating effects however with poor high temperature resistance. As such, according to the embodiments of the present disclosure, the composition includes boron nitride, such that the adhesion between the coating structure made of the composition and the materials coated with the coating structure is increased, and the process can be performed under a high temperature environment with a higher stability. In an embodiment, the coating structure made of the composition is coated on such as a metal roller, and the high temperature environment is such as a process temperature of 900-1050° C.

Further speaking, compared to the protection coating structure made by a conventional chromium-plating process, the coating structure made of the composition according to the embodiments of the present disclosure is more environmental friendly without producing chemical wastes that could be harmful to the environments.

In an embodiment, the composition may further include larger than 0 wt % to 3 wt % of C.

In an embodiment, the composition may further include larger than 0 wt % to 3 wt % of Mo.

In an embodiment, Y is present in amount of such as 1 wt % to 15 wt % in the composition, and O is present in amount of such as 1 wt % to 15 wt % in the composition.

In an embodiment, the mixture of Y and O in total is present in amount of such as 10 wt % to 30 wt % in the composition.

In an embodiment, N is present in amount of such as 0.1 wt % to 3 wt % in the composition.

In an embodiment, B is present in amount of such as 0.1 wt % to 3 wt % in the composition.

In an embodiment, in the composition, in addition to Al, Cr, O, N, Y, C, Mo and B with the above-mentioned weight percentages, the remainder of the composition includes such as Co. In another embodiment, in the composition, in addition to Al, Cr, O, N, Y, C, Mo and B with the above-mentioned weight percentages, the remainder of the composition is such as Ni. In a further embodiment, in the composition, in addition to Al, Cr, O, N, Y, C, Mo and B with the above-mentioned weight percentages, the remainder of the composition includes such as the mixture of Co and Ni.

According to the embodiments of the present disclosure, a coating structure is provided hereinafter. In some embodiments, the coating structure is made by such as applying the aforementioned composition.

In the embodiments, the composition of the coating structure includes 3 wt % to less than 15 wt % of Al, 10 wt % to less than 30 wt % of Cr, higher than 0 wt % to 15 wt % of O, higher than 0 wt % to 15 wt % of Y, higher than 0 wt % to 3 wt % of N, higher than 0 wt % to 3 wt % of C, Mo or B, and the remainder being at least one of Co or Ni. The coating structure has a thickness of such as 50-200 μm. In other words, in the coating structure of the embodiments, in addition to Al, Cr, O, N, Y, C, Mo and B having the above-mentioned weight percentages, the remainder of the composition of the coating structure is Cr, Ni, or the combination of Cr and Ni.

According to the embodiments of the present disclosure, since the coating structure has excellent characteristics, after the above-mentioned coating structure is coated on the surface of a work piece, the surface of the work piece can be protected, and the operating life of the work piece can be extended. In an embodiment, the work piece is such as a metal roller used in the high temperature annealing treatment in the manufacturing process of a steel plate, and the material of the metal roller may include iron (Fe), steel, or stainless steel.

In an embodiment, the coating structure is made of such as the aforementioned composition and by a high velocity oxy fuel (HVOF) spray. Since the particles of N, C, Mo and B are provided with better heat dissipation effects, the particles located adjacent and around boron nitride in the powder composition can absorb heat from heat dissipation particles when the high temperature spray process is performed. Accordingly, the particles in the powder composition can be better maintained at a high-temperature wetting condition; thus, the flatten level of the particles in the coating structure is further improved, the adhesion between adjacent particles is further improved, and the adhesion between the particles and the to-be-coated surface of the work piece is further improved as well.

Further speaking, the coating structure is made by the aforementioned composition; accordingly, without requiring changing the existing coating process, such as the spraying process, the coating structure having properties of high temperature resistance, wearing resistance, and anti-adhesion can be made.

Figure 1A:
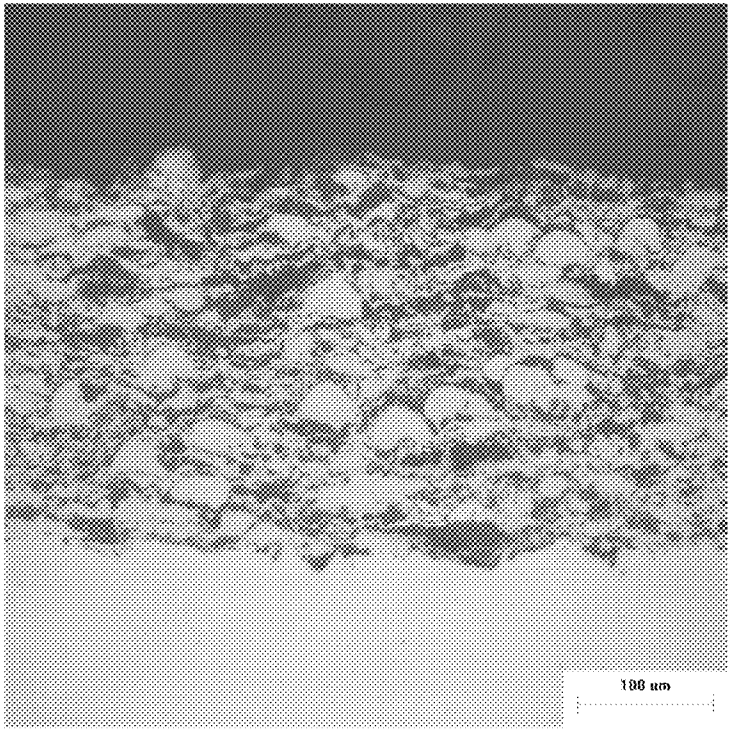
FIG. 1A shows an electronic microscopy of a coating structure according to a comparative embodiment.

FIG. 1A shows an electronic microscopy of a coating structure according to a comparative embodiment, FIG. 1B shows an electronic microscopy of a coating structure according to an embodiment of the present disclosure. The composition of the coating structure as shown in FIG. 1A applies Ni as the main component and includes 0-30 wt % of the mixture of Y and O. The composition of the coating structure as shown in FIG. 1B applies Ni and the main component and includes higher than 0 wt % to 3 wt % of N, higher than 0 wt % to 3 wt % of C, higher than 0 wt % to 3 wt % of Mo or B, and 0 wt % to 30 wt % of a mixture of Y and O. In the coating structure of a comparative embodiment as shown in FIG. 1A, the particles are more spherical rather than flattened; in contrast, in the coating structure of an embodiment as shown in FIG. 1B, due to the influence of heat dissipation particles, the particles as a whole have more flattened shapes, such that the bonding strength between the particles is higher, and the arrangement is more compact, resulting in a better adhesiveness and a higher stability.

In an embodiment, the mixture of Y and O in total is present in amount of such as 10 wt % to 30 wt % in the composition of the coating structure.

In an embodiment, N, C, Mo and B in total are present in amount of such as 0.1 wt % to 5 wt % in the composition of the coating structure.

In an embodiment, the composition of the coating structure may further include 0.4 wt % to 1 wt % of Y.

In an embodiment, in the composition of the coating structure, in addition to Al, Cr, O, N, Y, C, Mo and B with the above-mentioned weight percentages, the remainder of the composition of the coating structure is such as Co. In another embodiment, in the composition of the coating structure, in addition to Al, Cr, O, N, Y, C, Mo and B with the above-mentioned weight percentages, the remainder of the composition of the coating structure is such as Ni. In a further embodiment, in the composition of the coating structure, in addition to Al, Cr, O, N, Y, C, Mo and B with the above-mentioned weight percentages, the remainder of the composition of the coating structure is such as the mixture of Co and Ni.

According to the embodiments of the present disclosure, a manufacturing method of a coating structure is provided in the following. In some embodiments, the manufacturing method includes the following steps.

First, a composition is provided. The property of the composition is as aforementioned and omitted here. The composition is present in such as a powder form.

In the embodiments, the manufacturing method of the powder includes such as mixing all of the components; alternatively, the method may as well include mixing Al, Cr, O, Y, Ni and/or Cr, followed by adding N, C, Mo and B and then mixing all of the components.

Next, the powder composition is used to make the coating structure. The powder composition is coated on a metal substrate for forming a coating structure. In the embodiments, the coating method of the coating structure may be such as a powder coating process, an electric arc melting spraying process, a flame melting spraying process, a plasma melting spraying process, a high velocity oxy fuel (HVOF) spray process, a physical vapor deposition (PVD) process, or a chemical vapor deposition (CVD) process.

In the embodiment, the size that has been worn away can be filled by spraying the powder composition material by a melting spraying process, and thus the work piece, such as a metal substrate or a roller, can be repaired, such that the work piece can be recycled for use by a melting spraying technology. In addition, by spraying the powder composition material by a melting spraying process, a bonding strength of larger than 10000 psi between the coating structure and the metal substrate formed below which can be generated. As such, the bonding strength between the coating structure and the metal substrate can be enlarged without performing additional heat treatments. Moreover, by performing a heat melting spraying process, the metal components and the ceramic components in the powder composition can be sprayed simultaneously on the metal substrate for forming the coating structure.

In an embodiment, for example, a powder composition is used by performing a high velocity oxy fuel (HVOF) spray process for forming the coating structure. For example, the powder composition is sprayed on the metal substrate under conditions of such as performing at a predetermined fuel gas flow rate of such as 20-100 L/min, a predetermined oxygen flow rate of such as 300-500 L/min, and a predetermined carrier gas flow rate of such as 10-50 L/min, for forming a coating structure.

Further explanation is provided with the following examples. Components of compositions and test results of properties of the coating structures made of the compositions of some examples are listed for showing the properties of compositions according to the embodiments of the disclosure. However, the following examples are for purposes of describing particular embodiments only, and are not intended to be limiting. The components of the compositions and the test results of properties of the coating structures of each of the embodiments are listed in tables 1-2, wherein the ratios of each of the elements are represented as the weight percentages with respect to the whole composition.

Figure 2:
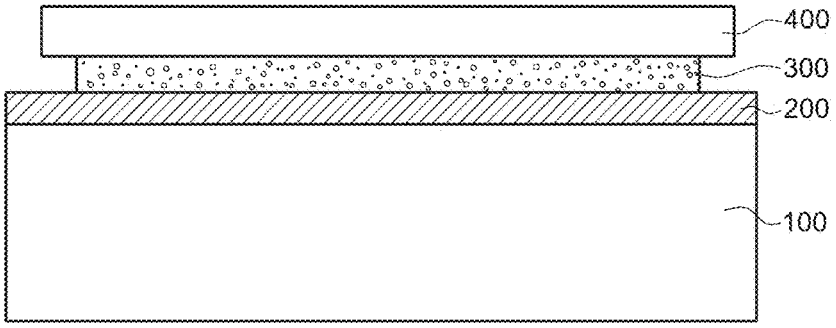
FIG. 2 shows a schematic drawing of a measuring method of a coating structure according to an embodiment of the present disclosure.

FIG. 2 shows a schematic drawing of a measuring method of a coating structure according to an embodiment of the present disclosure. The composition in form of powders is sprayed by a high temperature melting spraying process on a metal substrate 100 for forming a coating structure 200. Then, the coating structure 200 is covered by Mn powders 300 with 99.99% purity. Finally, a steel material 400, such as a 304 stainless steel plate, is pressed on and covers the Mn powders 300. After that, the whole structure is placed in a heating furnace and is heated at 900° C. for 3 hours. After the heating process is completed, the whole structure is taken out and the surface-sticking level of the coating structure 200 is investigated and analyzed by image analysis software. The compositions and test results of the coating structures of examples are listed in tables 1-2.

In tables 1-2, anti-manganese property is divided into three levels: "G (Good)", "O (OK)", and "P (Poor)", wherein "G" indicates good to use, "O" indicates OK to use yet poorer than "G", and "P" indicates poor to use and having more surface sticking problems. Surface oxide sticking level is divided into two levels: "H (High)" and "L (Low)", wherein "L" indicates that the oxide sticking on surface occupies less than 40% of the whole area of the surface. Moreover, in the compositions of the coating structures of examples 1-45 in table 1, in addition to Al, Cr, Y, O, N, C, Mo and B with the weight percentages listed in table 1, the remainder of the compositions is Co. In the compositions of the coating structures of examples 46-90 in table 2, in addition to Al, Cr, Y, O, N, C, Mo and B with the weight percentages listed in table 2, the remainder of the compositions is Ni.

TABLE 1

| Example | Co | Cr | Al | O | Y | N | Mo | C | B | Anti-manganese property | Surface oxide sticking level |
|---|---|---|---|---|---|---|---|---|---|---|---|
| 1 | — | 24 | 5 | 0 | 0 | 0 | 0 | | | P | H |
| 2 | — | 22 | 4 | 5 | 5 | 0.05 | 0.05 | | | P | H |
| 3 | — | 19 | 4 | 10 | 10 | 0.5 | 0.5 | | | O | L |
| 4 | — | 17 | 3 | 15 | 15 | 0.75 | 0.75 | | | G | L |
| 5 | — | 17 | 3 | 15 | 15 | 2.5 | 2.5 | | | G | L |
| 6 | — | 22 | 10 | 0 | 0 | 0 | 0 | | | P | H |
| 7 | — | 20 | 9 | 5 | 5 | 0.05 | 0.05 | | | P | H |
| 8 | — | 18 | 8 | 10 | 10 | 0.5 | 0.5 | | | O | L |
| 9 | — | 15 | 7 | 15 | 15 | 0.75 | 0.75 | | | G | L |
| 10 | — | 15 | 7 | 15 | 15 | 1.5 | 1.5 | | | G | L |
| 11 | — | 31 | 15 | 0 | 0 | 0 | 0 | | | P | H |
| 12 | — | 28 | 13 | 5 | 5 | 0.05 | 0.05 | | | P | H |
| 13 | — | 25 | 12 | 10 | 10 | 0.5 | 0.5 | | | O | L |
| 14 | — | 22 | 10 | 15 | 15 | 0.75 | 0.75 | | | G | L |
| 15 | — | 22 | 10 | 15 | 15 | 2.5 | 2.5 | | | G | L |
| 16 | — | 24 | 5 | 0 | 0 | | | 0 | | P | H |
| 17 | — | 22 | 4 | 5 | 5 | | | 0.05 | | P | H |
| 18 | — | 19 | 4 | 10 | 10 | | | 0.5 | | O | L |
| 19 | — | 17 | 3 | 15 | 15 | | | 0.75 | | G | L |
| 20 | — | 17 | 3 | 15 | 15 | | | 2.5 | | G | L |
| 21 | — | 22 | 10 | 0 | 0 | | | 0 | | P | H |
| 22 | — | 20 | 9 | 5 | 5 | | | 0.05 | | P | H |
| 23 | — | 18 | 8 | 10 | 10 | | | 0.5 | | O | L |
| 24 | — | 15 | 7 | 15 | 15 | | | 0.75 | | G | L |
| 25 | — | 15 | 7 | 15 | 15 | | | 1.5 | | G | L |
| 26 | — | 31 | 15 | 0 | 0 | | | 0 | | P | H |
| 27 | — | 28 | 13 | 5 | 5 | | | 0.05 | | P | H |
| 28 | — | 25 | 12 | 10 | 10 | | | 0.5 | | O | L |
| 29 | — | 22 | 10 | 15 | 15 | | | 0.75 | | G | L |

TABLE 1-continued

| Example | Co | Cr | Al | O | Y | N | Mo | C | B | Anti-manganese property | Surface oxide sticking level |
|---|---|---|---|---|---|---|---|---|---|---|---|
| 30 | — | 22 | 10 | 15 | 15 | | | 2.5 | | G | L |
| 31 | — | 24 | 5 | 0 | 0 | | | | 0 | P | H |
| 32 | — | 22 | 4 | 5 | 5 | | | | 0.05 | P | H |
| 33 | — | 19 | 4 | 10 | 10 | | | | 0.5 | O | L |
| 34 | — | 17 | 3 | 15 | 15 | | | | 0.75 | G | L |
| 35 | — | 17 | 3 | 15 | 15 | | | | 2.5 | G | L |
| 36 | — | 22 | 10 | 0 | 0 | | | | 0 | P | H |
| 37 | — | 20 | 9 | 5 | 5 | | | | 0.05 | P | H |
| 38 | — | 18 | 8 | 10 | 10 | | | | 0.5 | O | L |
| 39 | — | 15 | 7 | 15 | 15 | | | | 0.75 | G | L |
| 40 | — | 15 | 7 | 15 | 15 | | | | 1.5 | G | L |
| 41 | — | 31 | 15 | 0 | 0 | | | | 0 | P | H |
| 42 | — | 28 | 13 | 5 | 5 | | | | 0.05 | P | H |
| 43 | — | 25 | 12 | 10 | 10 | | | | 0.5 | O | L |
| 44 | — | 22 | 10 | 15 | 15 | | | | 0.75 | G | L |
| 45 | — | 22 | 10 | 15 | 15 | | | | 2.5 | G | L |

TABLE 2

| Example | Ni | Cr | Al | O | Y | N | Mo | C | B | Anti-manganese property | Surface oxide sticking level |
|---|---|---|---|---|---|---|---|---|---|---|---|
| 46 | — | 24 | 5 | 0 | 0 | 0 | 0 | | | P | H |
| 47 | — | 22 | 4 | 5 | 5 | 0.05 | 0.05 | | | P | H |
| 48 | — | 19 | 4 | 10 | 10 | 0.5 | 0.5 | | | O | L |
| 49 | — | 17 | 3 | 15 | 15 | 0.75 | 0.75 | | | G | L |
| 50 | — | 17 | 3 | 15 | 15 | 2.5 | 2.5 | | | G | L |
| 51 | — | 22 | 10 | 0 | 0 | 0 | 0 | | | P | H |
| 52 | — | 20 | 9 | 5 | 5 | 0.05 | 0.05 | | | P | H |
| 53 | — | 18 | 8 | 10 | 10 | 0.5 | 0.5 | | | O | L |
| 54 | — | 15 | 7 | 15 | 15 | 0.75 | 0.75 | | | O | L |
| 55 | — | 15 | 7 | 15 | 15 | 1.5 | 1.5 | | | O | L |
| 56 | — | 31 | 15 | 0 | 0 | 0 | 0 | | | P | H |
| 57 | — | 28 | 13 | 5 | 5 | 0.05 | 0.05 | | | P | H |
| 58 | — | 25 | 12 | 10 | 10 | 0.5 | 0.5 | | | O | L |
| 59 | — | 22 | 10 | 15 | 15 | 0.75 | 0.75 | | | G | L |
| 60 | — | 22 | 10 | 15 | 15 | 2.5 | 2.5 | | | G | L |
| 61 | — | 24 | 5 | 0 | 0 | | | 0 | | P | H |
| 62 | — | 22 | 4 | 5 | 5 | | | 0.05 | | P | H |
| 63 | — | 19 | 4 | 10 | 10 | | | 0.5 | | O | L |
| 64 | — | 17 | 3 | 15 | 15 | | | 0.75 | | G | L |
| 65 | — | 17 | 3 | 15 | 15 | | | 2.5 | | G | L |
| 66 | — | 22 | 10 | 0 | 0 | | | 0 | | P | H |
| 67 | — | 20 | 9 | 5 | 5 | | | 0.05 | | P | H |
| 68 | — | 18 | 8 | 10 | 10 | | | 0.5 | | O | L |
| 69 | — | 15 | 7 | 15 | 15 | | | 0.75 | | G | L |
| 70 | — | 15 | 7 | 15 | 15 | | | 1.5 | | G | L |
| 71 | — | 31 | 15 | 0 | 0 | | | 0 | | P | H |
| 72 | — | 28 | 13 | 5 | 5 | | | 0.05 | | P | H |
| 73 | — | 25 | 12 | 10 | 10 | | | 0.5 | | O | L |
| 74 | — | 22 | 10 | 15 | 15 | | | 0.75 | | G | L |
| 75 | — | 22 | 10 | 15 | 15 | | | 2.5 | | G | L |
| 76 | — | 24 | 5 | 0 | 0 | | | | 0 | P | H |
| 77 | — | 22 | 4 | 5 | 5 | | | | 0.05 | P | H |
| 78 | — | 19 | 4 | 10 | 10 | | | | 0.5 | O | L |
| 79 | — | 17 | 3 | 15 | 15 | | | | 0.75 | G | L |
| 80 | — | 17 | 3 | 15 | 15 | | | | 2.5 | G | L |
| 81 | — | 22 | 10 | 0 | 0 | | | | 0 | P | H |
| 82 | — | 20 | 9 | 5 | 5 | | | | 0.05 | P | H |
| 83 | — | 18 | 8 | 10 | 10 | | | | 0.5 | O | L |
| 84 | — | 15 | 7 | 15 | 15 | | | | 0.75 | G | L |
| 85 | — | 15 | 7 | 15 | 15 | | | | 1.5 | G | L |
| 86 | — | 31 | 15 | 0 | 0 | | | | 0 | P | H |
| 87 | — | 28 | 13 | 5 | 5 | | | | 0.05 | P | H |
| 88 | — | 25 | 12 | 10 | 10 | | | | 0.5 | O | L |
| 89 | — | 22 | 10 | 15 | 15 | | | | 0.75 | G | L |
| 90 | — | 22 | 10 | 15 | 15 | | | | 2.5 | G | L |

Figure 3:
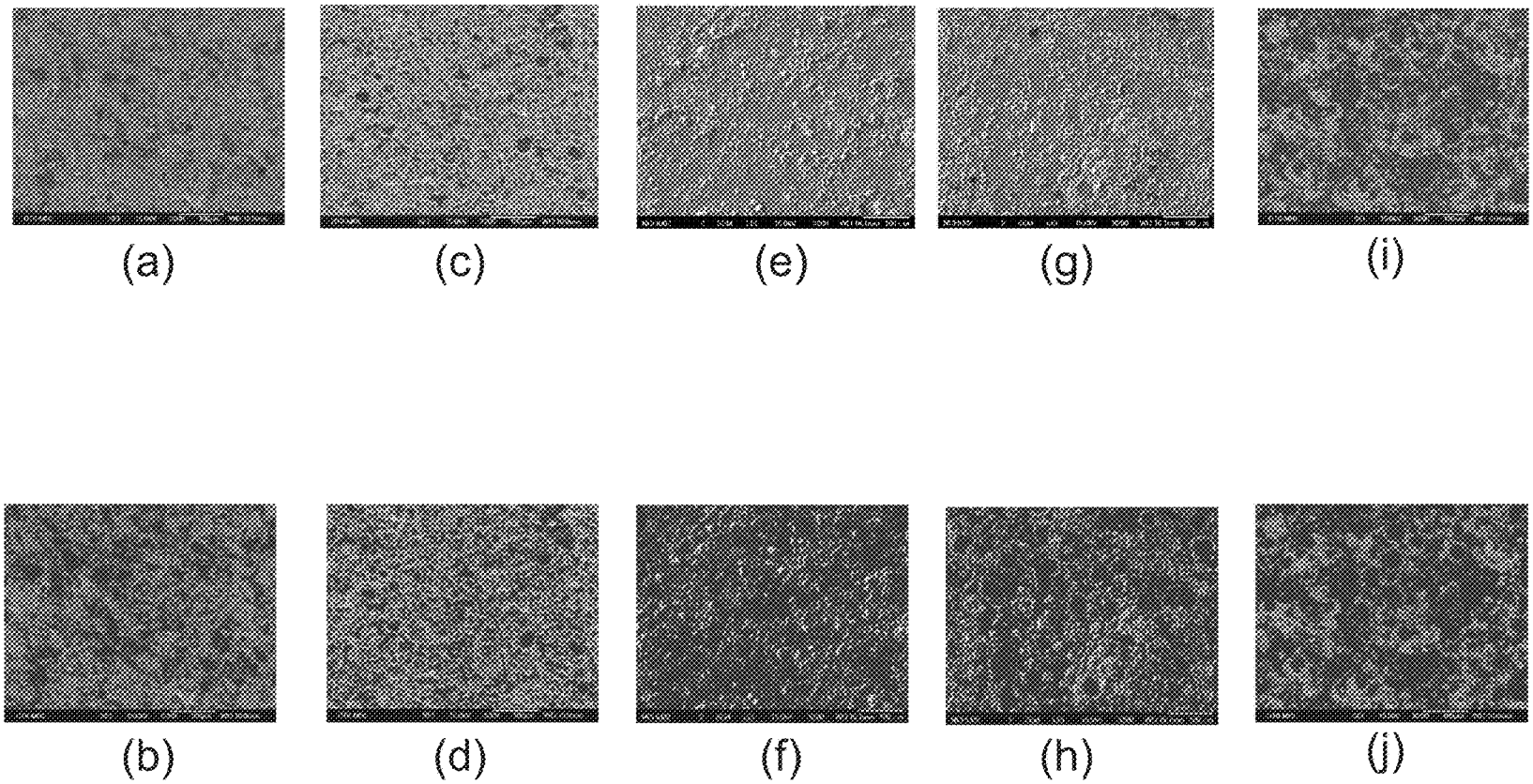
FIG. 3 shows electronic microscopies of coating structures according to a comparative embodiment and embodiments of the present disclosure after the measuring method as illustrated in FIG. 2 is performed thereon.

FIG. 3 shows electronic microscopies of coating structures according to a comparative embodiment and embodiments of the present disclosure after the measuring method as illustrated in FIG. 2 is performed thereon. The composition of the coating structure as shown in FIG. 3*a* applies Co as the main component and includes 20 wt % of aluminum oxide. The composition of the coating structure as shown in FIG. 3*b* applies Co as the main component and includes 0-3 wt % of N, C, Mo and B and 0-30 wt % of a mixture of Y and O. The composition of the coating structure as shown in FIG. 3*c* applies Ni as the main component and includes 0-3 wt % of N, C, Mo and B and 0-30 wt % of a mixture of Y and O. The composition of the coating structure as shown in FIG. 3*d* applies Ni as the main component and includes 0-3 wt % of N, C, Mo and B and 0-30 wt % of a mixture of Y and O. The composition of the coating structure as shown in FIG. 3*e* applies Ni as the main component.

The images of contaminants on the surfaces of the coating structures are analyzed, and the results are as shown in table 3.

TABLE 3

| Samples | Ratios of the area of the surface sticking portion (contaminant) occupied to the total area |
|---|---|
| FIG. 3A (Co—Al—O) | 65% |
| FIG. 3B (Co—Y—O—N—B) | 60% |
| FIG. 3C (Ni—Y—O—N—B) | 36% |
| FIG. 3D (Ni—30Y—O—N—B) | 34% |
| FIG. 3E (Ni—Y—O) | 42% |

As shown in table 3, in the coating structures (FIGS. 3*c* and 3*d*) of the embodiments, the surface sticking portion occupies only about 35.6% of the total area. In comparison, in the coating structure of a comparative embodiment as shown in FIG. 3*a*, the surface sticking portion occupies up to 65% of the total area. That is, the coating structure made of the compositions according to the embodiments of the present disclosure is provided with a largely increased anti-adhesion ability.

For example, according to the embodiments of the present disclosure, the coating structure is coated on such as a hearth roll of a transporting steel plate or a transporting steel band in a continuous steel annealing furnace. For example, the coating structure of the embodiments is coated on the surface of a hearth roll which contacts a high manganese steel in a high temperature zone at a high temperature of 850° C. or higher and under an atmosphere of 90-3% of $N_2$ and 7-0% of $H_2$; as such, reactions between the hearth roll and the surface of the steel plate or the steel band in the annealing furnace can be prevented, thus the generation of buildups on the surface of the hearth roll can be avoided, and continuous imprints or buildups left or adhered on the steel plate or the steel band can be further prevented. As such, the qualities of the steel band or the steel plate can be effectively increased, the satiations of shutting down, repairing, and/or replacing equipments can be reduced, the production efficiency is further increased, and the maintaining costs of the equipments can be reduced as well. In other words, with the use of the coating structure of the embodiments of the present disclosure, the qualities of the produced steel plates or steel bands can be stable, and the maintaining time as well as maintaining costs can be reduced.

While the disclosure has been described by way of example and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A composition for a coating structure, comprising:
3 wt % to less than 15 wt % of Al;
10 wt % to less than 30 wt % of Cr;
10 wt % to 15 wt % of O;
10 wt % to 15 wt % of Y; and
the remainder comprising at least one of Co or Ni, and the remainder further comprising an element selected from a group consisting of N, C, Mo, and B.

2. The composition according to claim 1, wherein N is present in amount of larger than 0 wt % to 3 wt %.

3. The composition according to claim 1, wherein C is present in amount of larger than 0 wt % to 3 wt %.

4. The composition according to claim 1, wherein Mo is present in amount of larger than 0 wt % to 3 wt %.

5. The composition according to claim 1, wherein B is present in amount of larger than 0 wt % to 3 wt %.

6. The composition according to claim 1, wherein Y and O in total are present in amount of 20 wt % to 30 wt %, N, C, Mo, and B in total are present in amount of 0.1 wt % to 5 wt %, and the remainder is Ni.

7. A coating structure formed of a composition, the composition comprising:
3 wt % to less than 15 wt % of Al;
10 wt % to less than 30 wt % of Cr;
10 wt % to 15 wt % of O;
10 wt % to 15 wt % of Y; and
the remainder comprising at least one of Co or Ni, and the remainder further comprising an element selected from a group consisting of N, C, Mo, and B, wherein the coating structure has a thickness of 50-200 μm.

8. The coating structure according to claim 7, wherein N is present in amount of larger than 0 wt % to 3 wt %.

9. The coating structure according to claim 7, wherein C is present in amount of larger than 0 wt % to 3 wt %.

10. The coating structure according to claim 7, wherein Mo is present in amount of larger than 0 wt % to 3 wt %.

11. The coating structure according to claim 7, wherein B is present in amount of larger than 0 wt % to 3 wt %.

12. The coating structure according to claim 7, wherein Y and O in total are present in amount of 20 wt % to 30 wt %, N, C, Mo, and B in total are present in amount of 0.1 wt % to 5 wt %, and the remainder is Ni.

* * * * *